US006108836A

United States Patent [19]

Keene, III

[11] Patent Number: 6,108,836

[45] Date of Patent: Aug. 29, 2000

[54] BED CLOTHES HAVING A FITTED BOTTOM SHEET AND AN ATTACHED TOP SHEET

[75] Inventor: James Henry Keene, III, Omaha, Nebr.

[73] Assignee: Humboldt Specialty Manufacturing Co., Omaha, Nebr.

[21] Appl. No.: 09/224,488

[22] Filed: Dec. 31, 1998

Related U.S. Application Data

[60] Provisional application No. 60/070,292, Dec. 31, 1997.

[51] Int. Cl.[7] ..... A47G 9/02

[52] U.S. Cl. ..... 5/497; 5/502; 5/435

[58] Field of Search ..... 5/485, 497, 502, 5/496, 499

[56] References Cited

U.S. PATENT DOCUMENTS

| | | | |
|---|---|---|---|
| 1,865,329 | 6/1932 | McHorter | 5/497 |
| 3,962,739 | 6/1976 | Crockett | 5/497 |
| 4,035,854 | 7/1977 | Pardee | 5/497 |
| 4,266,308 | 5/1981 | Shatz | 5/497 X |
| 5,189,744 | 3/1993 | Roberts | 5/497 |
| 5,375,274 | 12/1994 | Cuneo | 5/497 |
| 5,884,349 | 3/1999 | Gretsinger | 5/502 |

*Primary Examiner*—Michael F. Trettel
*Attorney, Agent, or Firm*—Suiter & Associates PC

[57] ABSTRACT

Bed clothes for a mattress include a fitted bottom sheet and an attached top sheet. The bottom sheet may form head and foot end pockets which envelop, respectively, the head and foot ends of the mattress, wherein the head end pocket extends along the bottom surface of the mattress from the head end for a length less than or equal to the thickness of the mattress (as measured between the top surface and the bottom surface of the mattress) and the foot end pocket extends along the bottom surface from the foot end for a length at least as great as one and one half times this thickness. The top sheet is attached to the foot end pocket of the bottom sheet so that a user's feet may extend past the foot end of the mattress without substantially displacing the top sheet in a direction generally from the head end to the foot end of the mattress.

18 Claims, 7 Drawing Sheets

BED CLOTHES HAVING A FITTED BOTTOM SHEET AND AN ATTACHED TOP SHEET

CROSS-REFERENCE TO RELATED APPLICATIONS

The present application claims the benefit under 35 U.S.C. § 119 of U.S. Provisional Application No. 60/070,292, filed on Dec. 31, 1997. Said U.S. Provisional Application No. 60/070,292 is herein incorporated by reference in its entirety.

TECHNICAL FIELD

The present invention relates generally to bed clothes for a mattress, and more specifically to bed clothes having a fitted bottom sheet which may be placed over the mattress and a top sheet which may be placed between a user and other bedding such as blankets, quilts, comforters, or the like.

BACKGROUND OF THE INVENTION

Bed clothes typically include a fitted bottom sheet which may be placed over a mattress and a top sheet which may be placed between a user and other bedding such as blankets, quilts, comforters, or the like. Fitted sheets are preferred over flat sheets because they may be quickly and neatly placed on a mattress without tedious folding and manipulation of the sheet's corners. Further, fitted sheets provide a convenient means for retaining the sheet on the mattress during use. Typically, prior art fitted sheets may be categorized as one of three types.

Perhaps the most commonly used type of fitted sheet comprises an elastic band attached along the ends of the sheet to draw the sheet closed about the sides of a mattress. These elastic bands may, however, be subject to wear after repeated use and may allow the sheet to come loose from the mattress as a user lying thereon changes positions.

A second type of fitted sheet employs generally triangular shaped panels sewn to each corner of the sheet to form corner pockets which hold the corners of the mattress. This type of sheet is most commonly utilized with waterbed mattresses, wherein the corner of the waterbed mattress may be lifted slightly to permit its insertion within the corner pocket. However, such corner pockets typically do not fit well on conventional mattresses and thus may also allow the sheet to come loose from the mattress.

U.S. Pat. No. 5,375,274 to Cuneo discloses a third type of fitted sheet. This sheet utilizes head and foot end pockets which hold, respectively, the head and foot ends of the mattress. However, both the head and foot end pockets of the Cuneo bottom sheet have a depth at least as great as the thickness of the mattress in order to securely retain the sheet on the mattress. Consequently, if the depth of the pockets is too great, the sheet may be somewhat difficult to place on or remove from the mattress especially if the mattress is utilized in confined areas such as a truck cabin, camper, or recreational vehicle, or, alternatively, if the depth of the pockets is too shallow, the sheet may slip off the mattress during use.

Typically, a top or flat sheet is placed over the fitted bottom sheet between the user and other bedding such as blankets, quilts, comforters, and the like. The top sheet may be tucked beneath the foot end of the mattress when the bed is made. However, top sheets frequently become loose from under the mattress during use, and are inconvenient to tuck in and refold when the bed is again made. Known to the art are bed clothes, made for use with waterbeds, which include a top sheet having a portion of the lower edge attached to a lower end of the fitted sheet. This method of attaching the top sheet to the fitted sheet eliminates many of the problems associated with loose top sheets. However, it fails to address the inconvenience of refolding the top sheet at the lower corner to provide a finished appearance should the waterbed sheet be utilized with a conventional mattress.

Cuneo, supra, also teaches bed clothes for a mattress wherein the top sheet is attached to the bottom sheet. However, because the top sheet of the Cuneo bed clothes is attached to the bottom sheet along the top surface of the mattress, users may find that they cannot extend their feet past the end of the mattress without substantially displacing the top sheet in a direction generally from the head end to the foot end of the mattress. This limitation may prove uncomfortable to many persons who prefer sleeping with their feet extending over the end of the mattress.

SUMMARY OF THE INVENTION

Accordingly, an object of the present invention is therefore to provide improved bed clothes for a mattress having a bottom sheet which is maintained in close fitted relation on the mattress.

Another object of the present invention is to provide bed clothes wherein the bottom sheet includes end pockets for securely retaining the bottom sheet on the mattress.

Yet another object of the present invention is to provide bed clothes wherein the bottom sheet includes a head end pocket which extends along the bottom surface of the mattress from the head end for a length at least as great as the thickness of the mattress (as measured between the top surface and the bottom surface of the mattress) and a foot end pocket which extends along the bottom surface of the mattress from the foot end for a length at least as great as one and one half times this thickness.

A further object of the present invention is to provide bed clothes having a top sheet attached to the bottom sheet in such a way as to provide a neat and finished appearance when the bed is made.

Still a further object of the present invention is to provide bed clothes having a top sheet which is attached to the bottom sheet in such a way as to allow a user's feet to extend past the foot end of the mattress without substantially displacing the top sheet in a direction generally from the head end to the foot end of the mattress.

The present invention provides novel bed clothes for a mattress including a fitted bottom sheet substantially covering the upper and side surfaces of the mattress and an attached top sheet which may cover the bottom sheet and a user lying thereon. The bottom sheet may form head and foot end pockets which envelop, respectively the head end and foot end of the mattress to retain the bottom sheet in position. Preferably, the head end pocket extends along the bottom surface of the mattress from the head end for a length at least as great as the thickness of the mattress (as measured between the top surface and the bottom surface of the mattress) and the foot end pocket extends along the bottom surface from the foot end for a length at least as great as one and one half times this thickness. The top sheet is attached to the foot end pocket of the bottom sheet along a bottom edge of the mattress so that a user's feet may extend past the foot end of the mattress without substantially displacing the top sheet in a direction generally from the head end to the foot end of the mattress.

It is to be understood that both the foregoing general description and the following detailed description are exemplary and explanatory only and are not restrictive of the invention claimed.

The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION

Reference will now be made in detail to the presently preferred embodiment of the invention, an example of which is illustrated in the accompanying drawings.

Figure 1A:
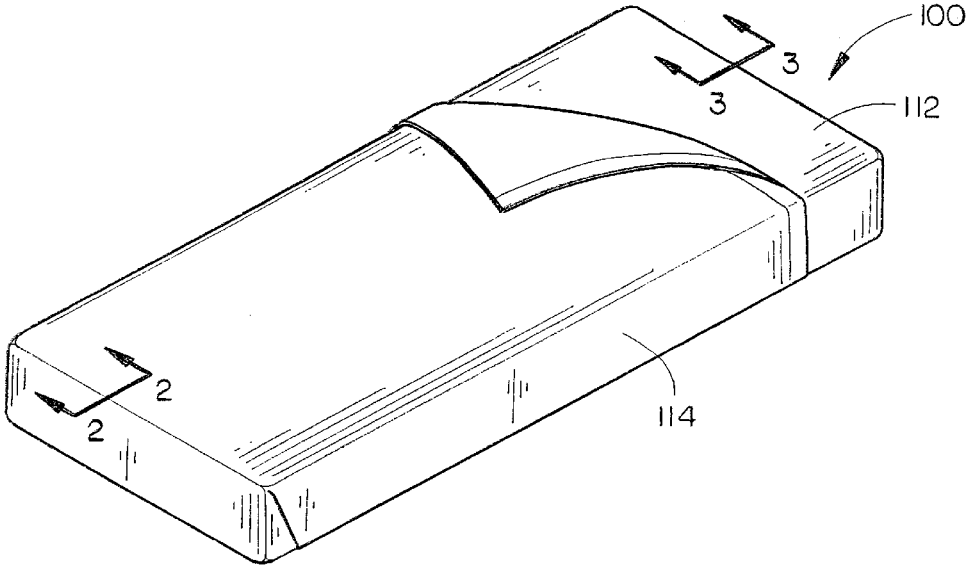
FIG. 1A is a perspective view depicting bed clothes according to an exemplary embodiment of the present invention including a fitted bottom sheet and an attached top sheet.

Referring now to FIG. 1A, bed clothes of the present invention are identified generally by the numeral 100 and include a fitted bottom sheet 112 and an attached top sheet 114. Preferably, the fitted bottom sheet 112 may be placed over a mattress so that it substantially covers the upper and side surfaces of a mattress and is maintained in close fitted relation thereto. The bottom sheet 112 may be formed of one or more pieces of material which are sewn or otherwise attached together to form a single assembly customized to fit a particular mattress with predetermined dimensions. The material may be a fabric such as, for example, a polyester/cotton blend, cotton, satin, flannel, etc, which is subject to limited shrinkage when washed and is preferably somewhat inelastic.

Figure 1B:
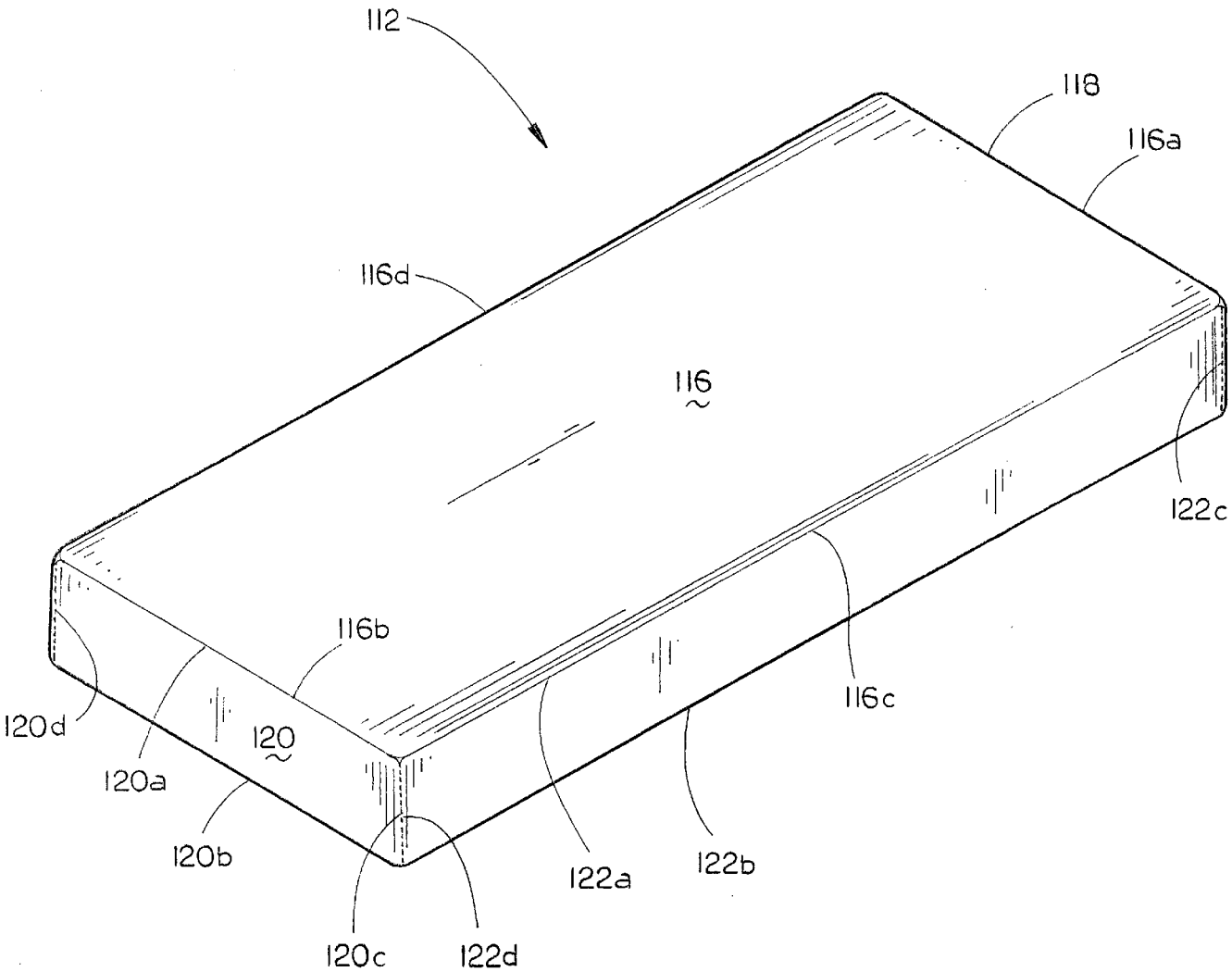
FIG. 1B is a perspective view depicting the bottom sheet of the bed clothes shown in FIG. 1A, wherein the bottom sheet is depicted without the attached top sheet for illustration purposes.

When placed over the mattress, as shown in FIG. 1B, the bottom sheet 112 forms a top panel 116, a head end panel 118, a foot end panel 120, and opposing side panels 122 and 124 displaced over and covering, respectively, the top surface, head end surface, foot end surface, and opposing side surfaces of the mattress. The top panel 116 which preferably has dimensions which substantially match the dimensions of the top surface of the mattress, extends over the edges of the mattress to form a head end edge 116*a*, a foot end edge 116*b*, and opposing side edges 116*c* and 116*d*.

Figure 2:
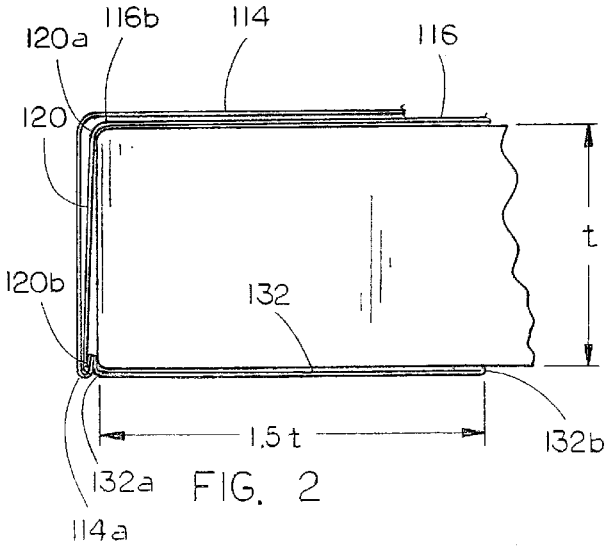
FIG. 2 is a sectional view taken at lines 2—2 in FIG. 1A, illustrating the foot end pocket of the bottom sheet and attachment of the top sheet to the bottom sheet.
Figure 4:
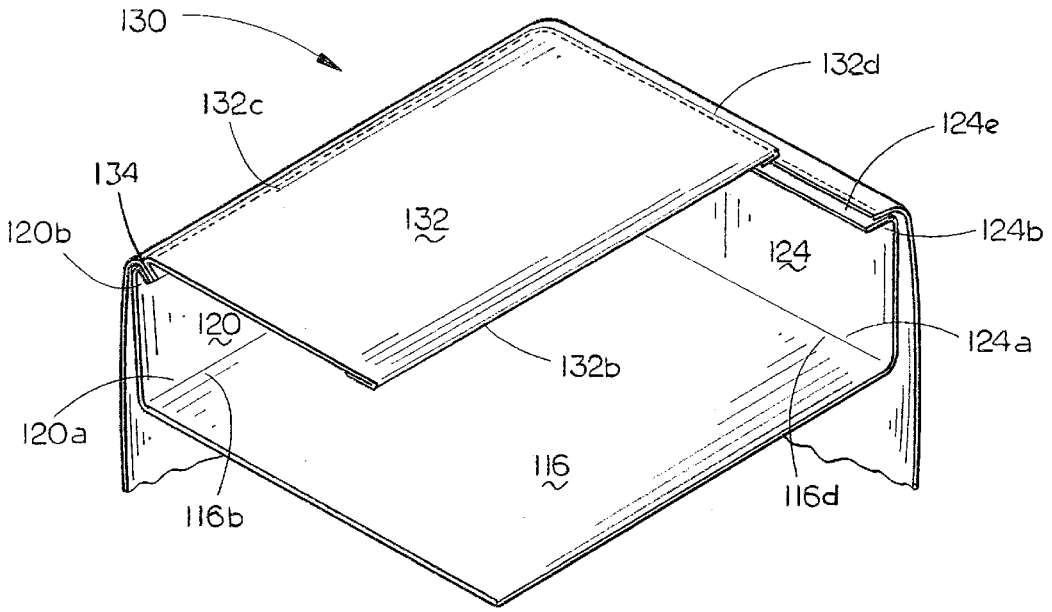
FIG. 4 is a perspective view further illustrating the foot end pocket shown in FIG. 2.

As shown in FIGS. 1B, 2 and 4, the bottom sheet 112 preferably comprises a single piece of material which may extend or wrap over foot end edge 116*b* to form foot end panel 120. Alternatively, however, the foot end panel 120 may be made from a separate piece of material and sewn to the top panel 116. Preferably, the foot end panel 120 has dimensions which substantially match those of the foot end surface of the mattress and includes a foot end panel upper edge 120*a* which continuously adjoins the top panel 116 along foot end edge 116*b*. The foot end panel 120 also comprises a foot end panel lower edge 120*b* and opposing foot end panel side edges 120*c* and 120*d*.

Figure 3:
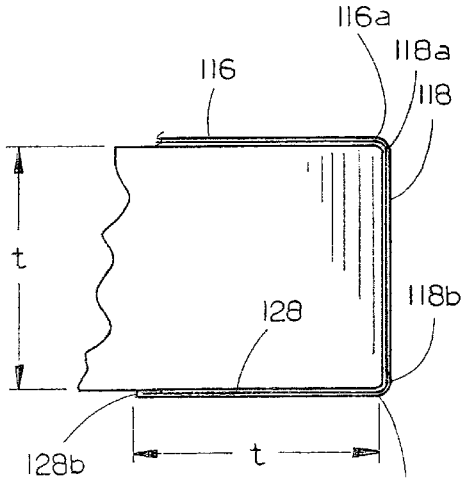
FIG. 3 is a sectional view taken at lines 3—3 in FIG. 1A, illustrating the head end pocket of the bottom sheet.
Figure 5:
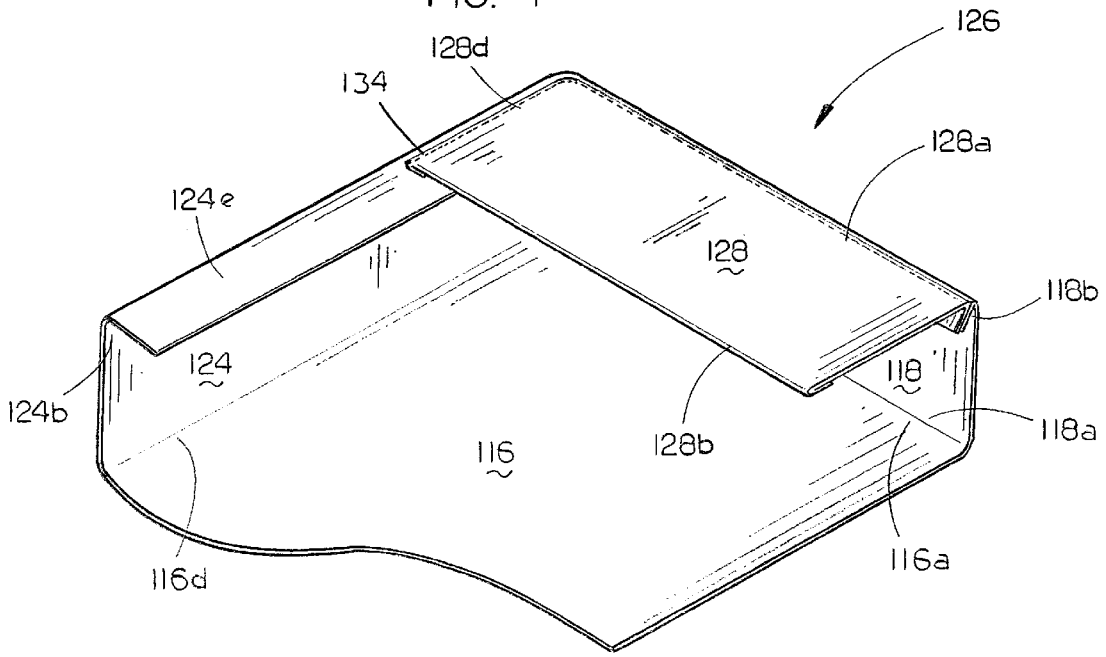
FIG. 5 is a perspective view further illustrating the head end pocket shown in FIG. 3.

Similarly, as shown in FIGS. 1B, 3 and 5, the bottom sheet 112 material may extend or wrap over head end edge 116*a* to form head end panel 118. Alternatively, the head end panel 118 may be made from a separate piece of material and sewn to the top panel 116. Like the foot end panel 120, the head end panel 118 preferably has dimensions which substantially match those of the head end surface of the mattress and includes a head end panel upper edge 118*a*, which continuously adjoins the top panel 116 along head end edge 116*a*. The head end panel also comprises a head end panel lower edge 118*b* and opposing head end panel side edges 118*c* and 118*d*.

As shown in FIGS. 1B, 4, 5 and 6, the bottom sheet 112 material may further extend or wrap around opposing side edges 116*c* and 116*d* to form opposing side panels 122 and 124. Alternatively, the side panels 122 and 124 may be made of separate pieces of material and sewn to the top panel 116. Preferably, the side panels 122 and 124 have dimensions which match those of the side surfaces of the mattress and include side panel upper edges 122*a* and 124*a*, which continuously adjoin the top panel 116 along side edges 116*c* and 116*d*. The side panels 122 and 124 also comprise side panel lower edges 122*b* and 124*b* and opposing side panel side edges 122*c* and 122*d* and 124*c* and 124*d*. Preferably, side panel side edges 122*c* and 124*c* are attached continuously along their entire length to head end panel side edges 118*c* and 118*d*, respectively. Similarly, side panel side edges 122*d* and 124*d* are attached to foot end panel side edges 120*c* and 120*d*. Each side panel 122 and 124 may extend only to lower edges 122*b* and 124*b*, or may wrap around lower edges 122*b* and 124*b* to form bottom side panels 122*e* and 124*c*. Alternatively, bottom side panels 122*e* and 124*e* may be made from separate pieces of material and sewn to the side panels 122 and 124.

Figure 6:
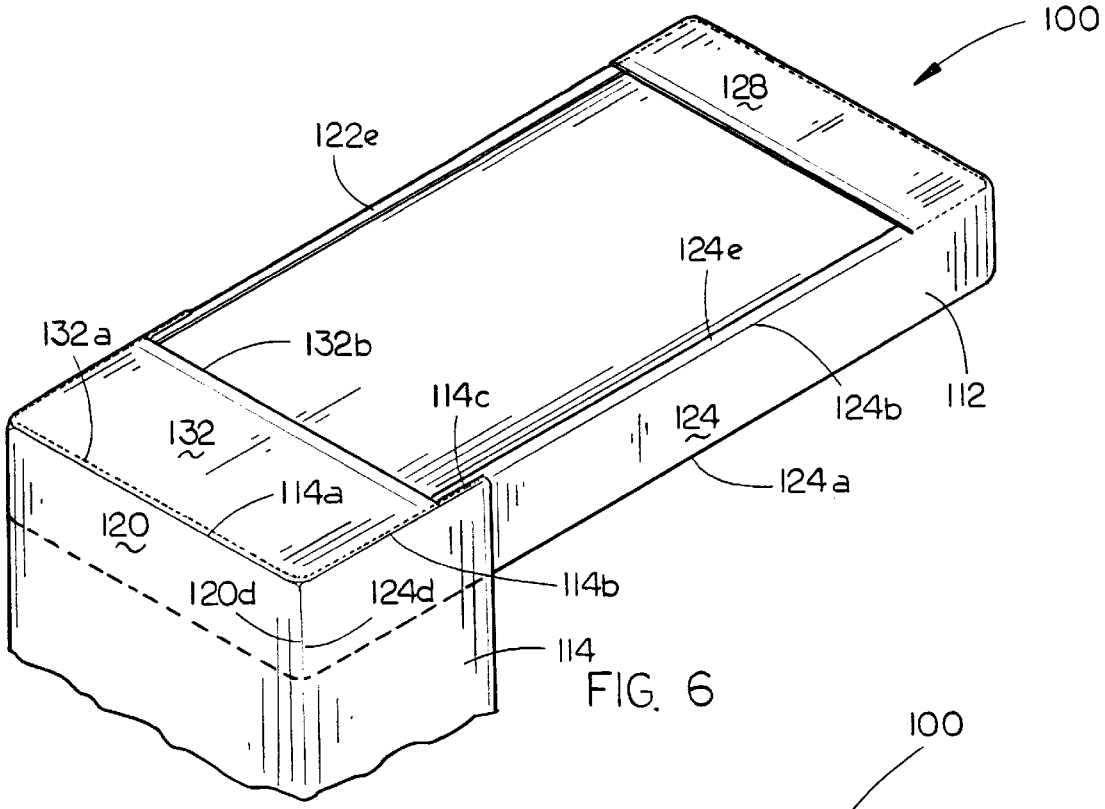
FIG. 6 is a perspective view of the bottom surface of the mattress having bed clothes according to the present invention as shown in FIG. 1A disposed thereon.

As shown in FIGS. 2, 4, and 6, a foot end pocket 130 may be formed in the bottom sheet 112 at the foot end of the mattress by attaching a rectangular foot end bottom panel 132 along the lower edges of foot end panel 120 and side panels 122 and 124. The foot end bottom panel 132 may have a forward edge 132*a* which is attached to the foot end panel 120 along the foot end panel lower edge 120*b*. The foot end bottom panel 132 preferably extends rearwardly from the forward edge 132*a* for a length of at least as great as approximately one and one half (1½) times the thickness ("t") of the mattress 114, and ends at rearward edge 132*b*.

Foot end bottom panel end edges 132*c* and 132*d* may be attached along the side panel bottom edges 122*b* and 124*b*, respectively. The seams between the bottom panel forward edge 132*a* and the foot end panel lower edge 120*d*, and between the bottom panel end edges 132*c* and 132*d* and the side panel bottom edges 122*b* and 124*b* may include reinforcement material 134 such as non-stretch webbing or tape. This material 134 preferably causes substantially all stretching of the bottom sheet fabric to occur the top panel 116, head end panel 118, foot end panel 120, opposing side panels 122 and 124 to improve the fit and appearance of the bottom sheet 112 on the mattress.

As shown in FIGS. 3, 5 and 6, ahead end pocket 126 may similarly be formed in the bottom sheet 112 at the head end of the mattress by forming a rectangular head end bottom panel 128 having a forward edge 128*a* which is attached to the head end panel 118 along the head end panel lower edge 118*b*. The head end bottom panel 128 preferably extends rearwardly from the forward edge 128*a* for a length approximately at least as great as the thickness ("t") of the mattress, and ends at a rearward edge 128*b*. Alternatively, the head end bottom panel 128 may extend rearwardly from the forward edge 128*a* to the rearward edge for a length less than or equal to the thickness ("t") of the mattress. Bottom panel end edges 128*c* and 128*d* may be attached along the side panel bottom edges 122*b* and 124*b*, respectively. The seams between the bottom panel forward edge 128*a* and the foot end panel lower edge 118*d*, and between the bottom panel end edges 128*c* and 128*d* and the side panel bottom edges 122*b* and 124*b* may include reinforcement material 134 such as non-stretch webbing or tape. This material 134 preferably causes substantially all stretching of the bottom sheet fabric to occur the top panel 116, head end panel 118, foot end panel 120, opposing side panels 122 and 124 to improve the fit and appearance of the bottom sheet 112 on the mattress.

The bottom sheet 112 is preferably formed of one or more pieces of an inelastic fabric which may be customized to the dimensions of the mattress to be covered. For example, the bottom sheet 112 may be customized to fit a standard mattress having a size typically characterized as, for example, twin, full, queen, or king. Alternatively, the bottom sheet may be customized to fit specialized mattresses such as mattress utilized in trucks, campers, recreational vehicles, children's beds, cribs, or the like. For example, a typical mattress utilized in the cabin of a truck may have dimensions ranging from 32 to 42 inches by 78 to 80 inches, and may have a thickness ("t") of between 6 inches and 7.5 inches. The head and foot end pockets 126 and 130, formed along the entire head and foot ends of the mattress securely maintain the bottom sheet 112 in position on the mattress. It has been found that by making the width of foot end bottom panel 132 approximately equal to one and one half (1½) times the thickness of the mattress and head end bottom panel 128 approximately equal to thickness of the mattress, the bottom sheet 112 may be more securely maintained on the mattress 114 while still facilitating removal by the user. Widths less than these dimensions are subject to slipping off the ends of the mattress during normal use while a widths substantially greater may cause the bottom sheet to be difficult to remove and replace.

Figure 7:
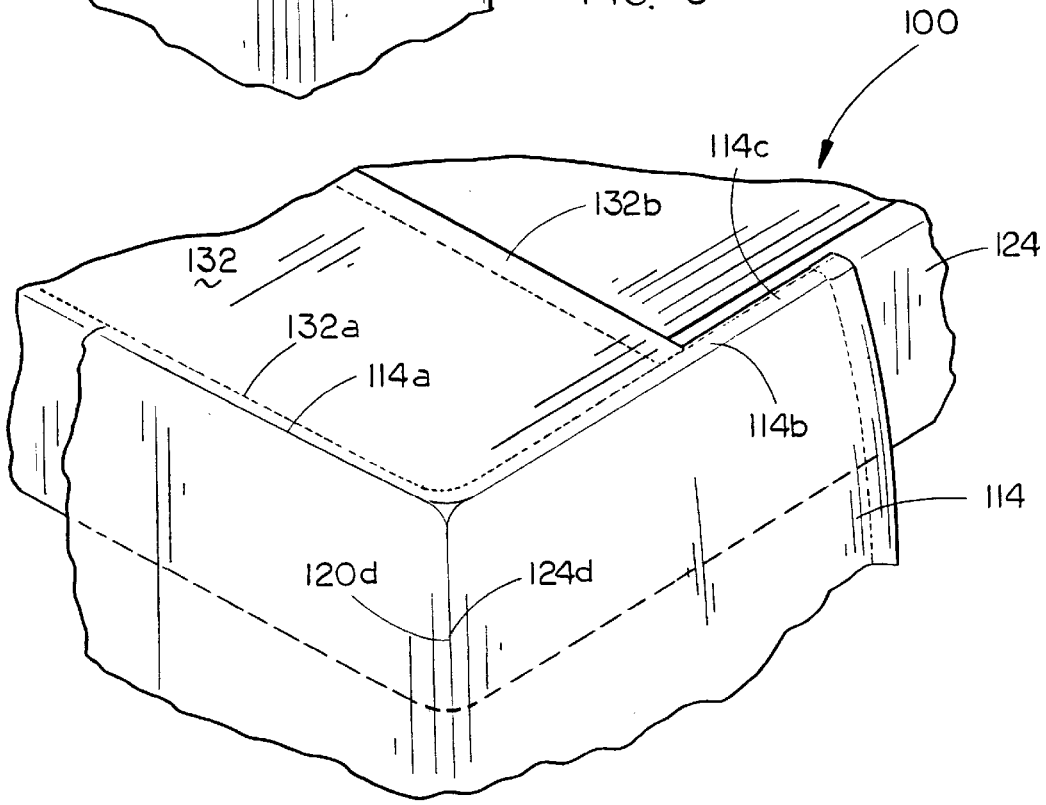
FIG. 7 is a perspective view of the bed clothes shown in FIG. 1, further illustrating attachment of the top sheet to the bottom sheet.

Referring now to FIGS. 1A, 1B, 2, 4, 6, and 7, bed clothes 100 may include an attached top sheet 114 which may cover the bottom sheet 112 and a user lying thereon, wherein the top sheet 114 may be placed between the user and other bedding such as blankets, quilts, comforters, or the like. As shown in FIGS. 6 and 7, the top sheet 114 may be formed of a separate piece of material having a lower end 114*a* which is attached to the foot end pocket 130 of the bottom sheet 112 so that a user's feet may extend past the foot end of the mattress without substantially displacing the top sheet 114 in a direction generally from the head end to the foot end of the mattress. Preferably, the lower end 114*a* of the top sheet 114 is attached continuously along the foot end panel lower edge 120*b* and foot end bottom panel forward edge 132*a*. The top sheet 114 may have sufficient width to allow side sections 114*b* of the top sheet lower end 114*a* to extend beyond the side edges 120*c* and 120*d* of the foot end panel 120. These side sections 114*b* may be attached to the bottom sheet 112 along foot end bottom panel side edges 132*c* and 132*d* and may include portions 114*c* which may extend along the side panel lower edges 122*b* and 124*b* (e.g., along bottom side panels 122*e* and 124*e*) past the foot end bottom panel rearward edge 132*b*. Preferably, the lower end 114*a* of the top sheet 114 is sewn between, respectively, the foot end panel lower edge 120*b* and foot end bottom panel forward edge 132*a* and the side panel lower edges 122*b* and 124*b* (or, optionally, bottom side panels 122*e* and 124*e*) and foot end bottom side edges 132*c* and 132*e* to securely attach the top sheet 114 to the bottom sheet 112.

The bed clothes 100 may be placed on a mattress by first placing the deeper foot end pocket 130 over the foot end of the mattress and then placing the shallower head end pocket 126 over the head end of the mattress. The top sheet 114 is then pulled upward and flattened over the top surface of the mattress. To remove the bed clothes 100 from the mattress the process is reversed and the head end pocket 126 is removed first. Preferably, the deeper head end pocket 130 provides improved retention of the bottom sheet 112 to the mattress, while the shallower head end pocket 126 allows the bottom sheet to be more easily placed on or removed from the mattress by a user.

Figure 8A:
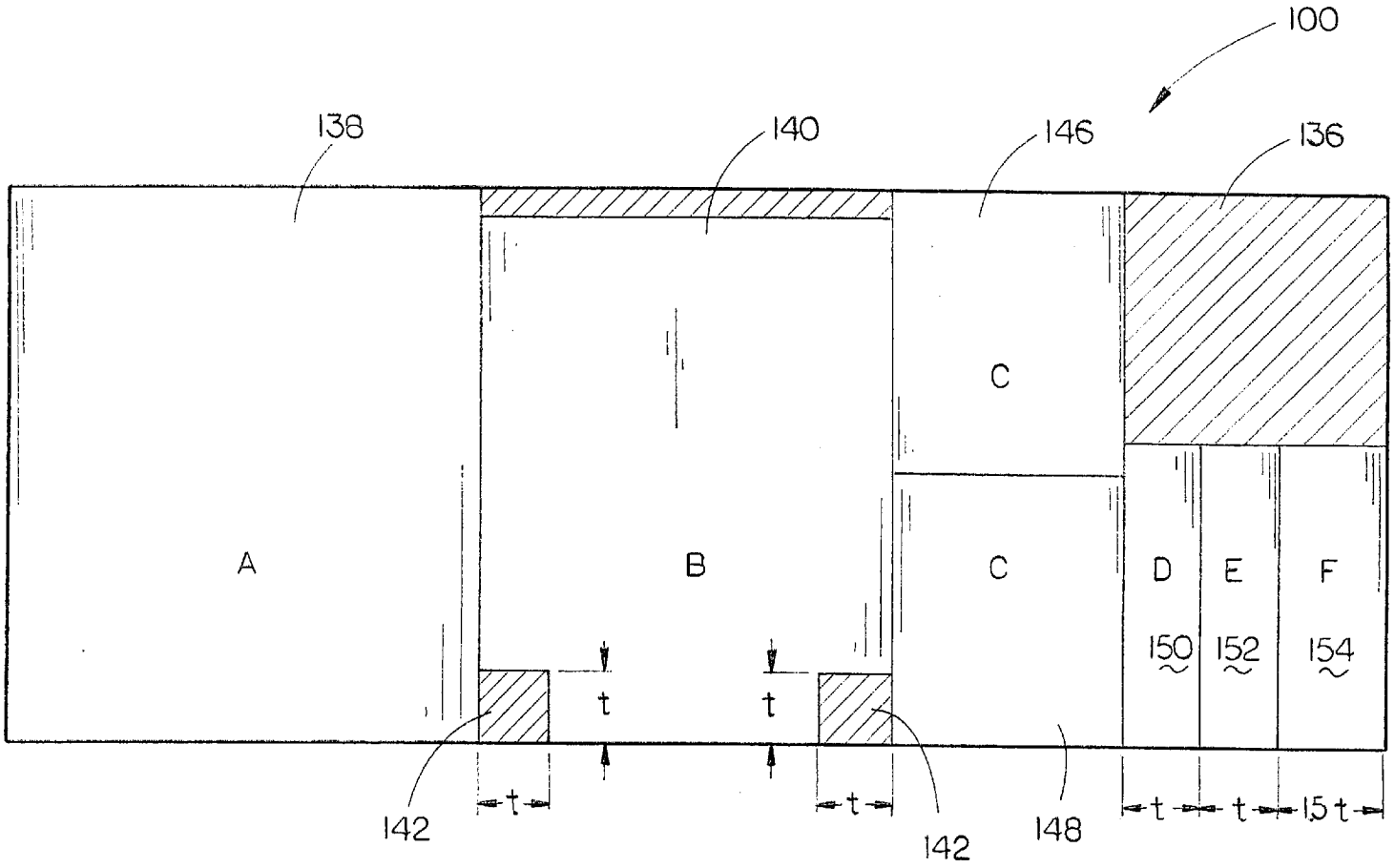
FIG. 8A is a top plan view illustrating a sheet of fabric from which the various panels of the top and bottom sheets may be cut.

Referring now to FIG. 8A, the bed clothes 100 of the present invention are preferably cut from a single sheet of fabric 136 according to a predetermined pattern to improve efficiency of manufacturing and reduce waste. Typically, a sheet of fabric may have a nominal width of 90 inches. However, this width may vary, for example, from 89 inches to over 95 inches.

Figure 8B:
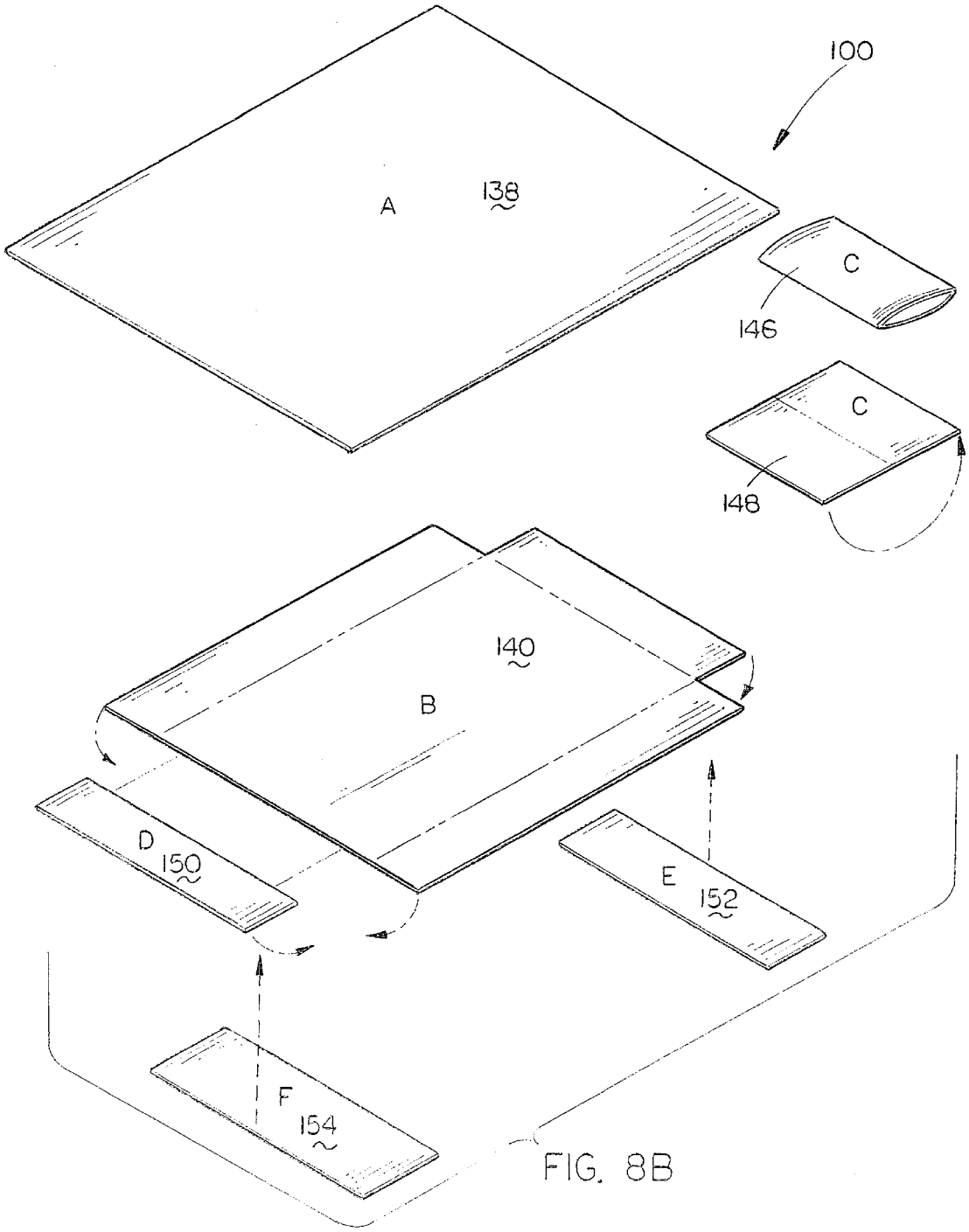
FIG. 8B is a perspective view illustrating assembly of the panels shown in FIG. 8A.

As shown in FIGS. 8A and 8B, sections of fabric may be appropriately sized to fit a mattress having a thickness ("t"), a length ("l"), and a width ("w"). These sections may be cut from the sheet of fabric 136 and sewn together to form the bottom sheet 112 and top sheet 114 (see FIG. 1A) of the bed clothes 100. Section "A" 138, which is utilized to make the top sheet 114 (FIG. 1A), may have a length approximately equal to the width of the sheet of fabric 136 and a width approximately equal to the width of the mattress ("w") plus a predetermined overhang, for example 31 inches. Section "B" 140 may have a width equal to the width of the mattress ("w") plus two times the thickness of the mattress ("t") and an overall length equal to the length of the mattress ("l") plus the thickness of the mattress ("t") minus a predetermined length, for example 1 inch, to cause the bottom sheet to fit snugly on the mattress. As shown in FIG. 8A, opposing, generally square portions 142 of fabric may be removed from section "B" 140 so that it may be folded to form the top panel 116, head end panel 118 and side panels 122 and 124 of the bottom sheet 112 (FIGS. 1A, 1B, and 6). Portions 142 may have a length and width slightly greater than the thickness of the mattress ("t") to account for losses when section "B" is folded and sewn. Sections "C" 146 and 148 may be utilized to make pillow cases. These sections may have a length of approximately one half (½) the length of the sheet of fabric 136 and a width equal to the width of the pillow case plus an allowance for sewing. Section "D" 150 may have a width approximately equal to the thickness of the mattress ("t"), and may form the foot end panel 120 (FIG. 1). Section "E" 152 may have a width approximately equal to the thickness of the mattress ("t"), and may form the head end bottom panel 128 (FIG. 6). Section "F" 154 may have a width at least as great as approximately one and one half (1½) times the thickness of the mattress ("t"), and may form the foot end bottom panel 132 (FIG. 6). Section "D" 150, section "E", and section "F" may each have a length approximately equal to the width of the mattress ("W").

Figure 9A:
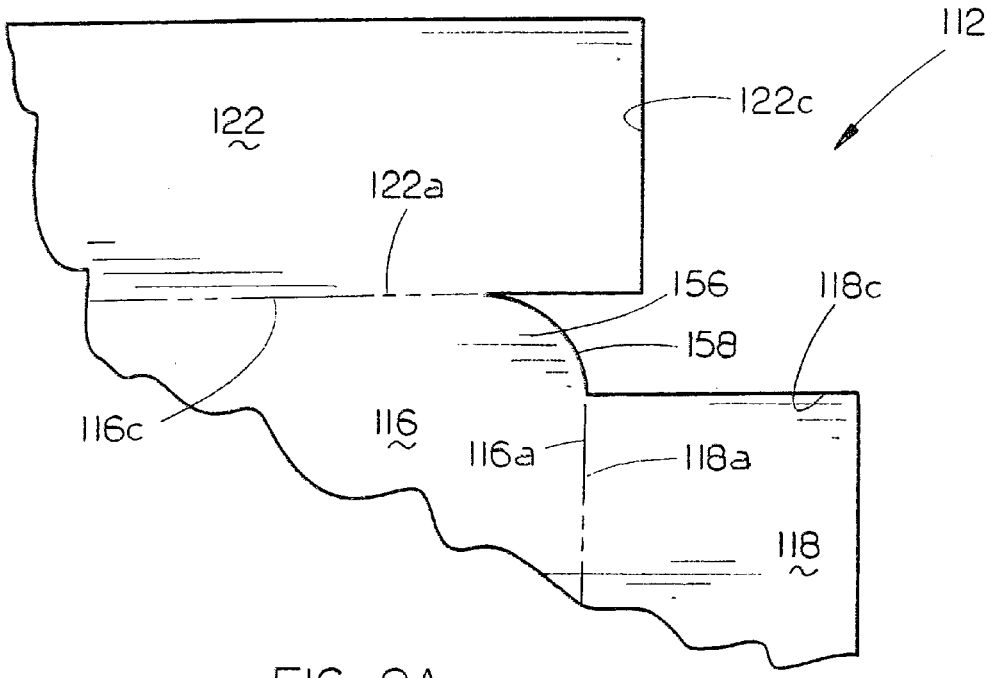
FIG. 9A is a top plan view depicting a sheet of fabric cut to form a rounded corner adapted to conform to a rounded corner of a mattress.
Figure 9B:
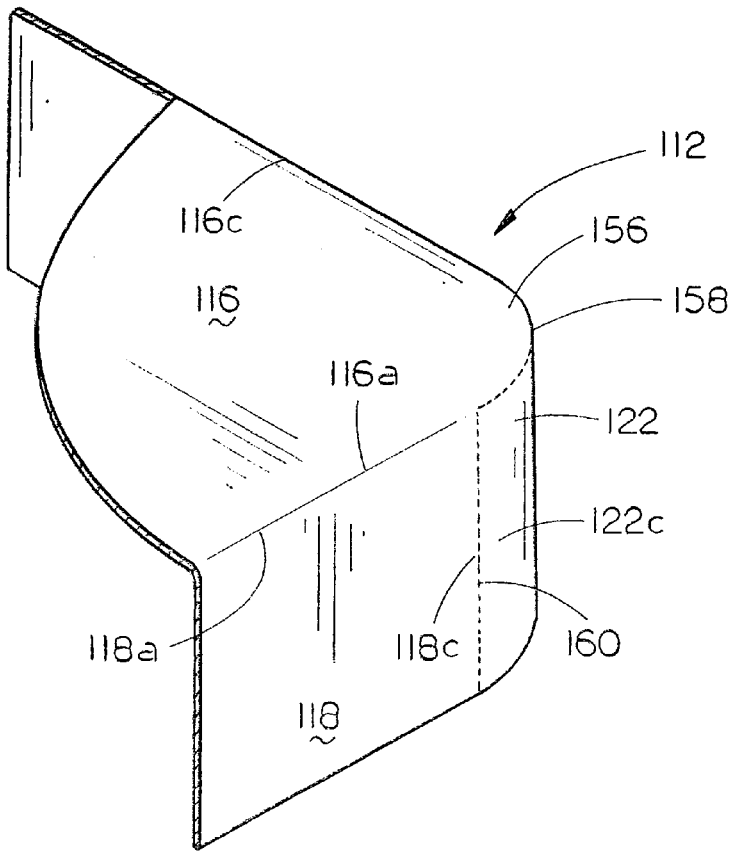
FIG. 9B is a perspective view showing a finished rounded corner.

Turning now to FIGS. 9A and 9B, each corner 156 of the bottom sheet 112 may have a radius which conforms to the radius of a respective corner of the mattress, thereby improving the appearance of the bottom sheet 112 and distributing forces in its fabric more evenly. As shown in FIG. 9A, the bottom sheet 112 may have a radius 158 formed therein between a side panel, for example side panel 122, and an end panel, for example the head end panel 118. The radius 158 is preferably cut between a fold line 160*a* formed by adjoining top panel side edge 116*c* and side panel upper edge 122*a* and a fold line formed by adjoining top panel head end edge 116*a* and head end panel upper edge 118*a*. Preferably, side panel side edge 122*c* may extend slightly past the fold line formed by adjoining top panel head end edge 116*a* and 118*a*. As shown in FIG. 9B, the side panel 122 may be folded along the fold line formed by adjoining top panel side edge 116*c* and side panel upper edge 122*a* and the head end panel 118, along the fold line formed by adjoining top panel head end edge 116*a* and head end panel upper edge 118*a* so that side panel side edge 122*c* adjoins head end panel side edge 118*c* along seam 160. The side panel upper edge 122*a* and head end panel upper edge 118*a* may further be sewn to the corner radius 158 to form the finished rounded corner 156.

In view of the above detailed description of a preferred embodiment and modifications thereof, various other modifications will now become apparent to those skilled in the art. The claims below encompass the disclosed embodiments and all reasonable modifications and variations without departing from the spirit and scope of the invention.

What is claimed is:

1. Bed clothes for a mattress having an upper surface, a bottom surface, side surfaces, opposed head and foot ends, and a thickness as measured between said top and bottom surfaces, said bed clothes comprising:

a bottom sheet suitable for substantially covering at least the upper surface and side surfaces, said bottom sheet including a head end pocket capable of receiving the head end and a foot end pocket capable of receiving the foot end when said bottom sheet is placed on the mattress to at least partially secure said bed clothes to the mattress; and a top sheet attached to said bottom sheet along a bottom edge portion of said foot end pocket so as to allow a user's feet to extend past the foot end without substantially displacing said top sheet in a direction generally from the head end to the foot end;

wherein, when said bed clothes are placed on a mattress, said foot end pocket extends along the bottom surface from the foot end for a length at least as great as one and one half times the thickness and said head end pocket extends along the bottom surface from the head end for a length less than the length said foot end pocket extends along the bottom surface from the foot end.

2. The bed clothes of claim 1, wherein said bottom sheet and said top sheet comprise a fabric.

3. The bed cloths of claim 2, wherein said fabric is a cotton/polyester blend.

4. The bed clothes of claim 2, wherein said fabric is cotton.

5. The bed clothes of claim 1, wherein said bottom sheet further comprises two or more rounded corners, each of said two or more rounded corners adapted to conform to a rounded corner of said mattress.

6. The bed clothes of claim 1, wherein said head end pocket and said foot end pocket each comprise a bottom panel adapted to extend under said bottom surface, said bottom panel including reinforcing material adapted to cause substantially all stretching of said bottom sheet to occur over said upper surface and said side surfaces.

7. The bed clothes of claim 1, wherein said bottom sheet and said top sheet are attached by stitching.

8. Bed clothes for a mattress having a top surface, a bottom surface, opposed first and second side surfaces, opposed head and foot end surfaces, and a thickness as measured between said top and bottom surfaces, said bed-clothes comprising:

a sheet for substantially covering the top surface, opposed first and second side surfaces and opposed head and foot end surfaces, said sheet forming a head end pocket suitable for enveloping a head end of the mattress and a foot end pocket suitable for enveloping a foot end of the mattress, said head end pocket and said foot end pocket cooperating to at least partially secure said sheet to the mattress;

wherein said head end pocket extends along the bottom surface from the head end for a length approximately less than the thickness of the mattress; and wherein said foot end pocket extends along the bottom surface from the foot end for a length at least as great as approximately one and one half times the thickness of the mattress.

9. The bed clothes of claim 8, further comprising a top sheet attached to said foot end pocket adjacent to bottom edges of said opposed first and second side surfaces and said foot end surface.

10. The bed clothes of claim 9, wherein said bottom sheet and said top sheet comprise a fabric.

11. The bed cloths of claim 10, wherein said fabric is a cotton/polyester blend.

12. The bed clothes of claim 10, wherein said fabric is cotton.

13. The bed clothes of claim 9, wherein said bottom sheet and said top sheet are attached by stitching.

14. The bed clothes of claim 8, wherein said bottom sheet further comprises two or more rounded corners, each of said two or more rounded corners adapted to conform to a rounded corner of said mattress.

15. The bed clothes of claim 8, wherein said head end pocket and said foot end pocket each comprise a bottom panel adapted to extend under said bottom surface, said bottom panel including reinforcing material adapted to cause substantially all stretching of said bottom sheet to occur over said top surface, said opposed first and second side surfaces, and said opposed head and foot end surfaces.

16. The bed clothes of claim 8, wherein said top sheet and said foot end pocket are adapted to allow a user's feet to extend past said foot end without substantially displacing said top sheet in a direction generally from said head end to said foot end.

17. Bed clothes for a mattress, comprising:

a bottom sheet suitable for substantially covering at least a top surface of the mattress, said bottom sheet including a head end pocket suitable for enveloping the head end of the mattress and a foot end pocket suitable for enveloping the foot end of the mattress; and a top sheet attached to said bottom sheet along a bottom edge portion of said foot end pocket for extending over the top surface of the mattress;

wherein said foot end pocket extends along the bottom surface of the mattress from said foot end for a length at least as great as one and one half times the thickness of the mattress for preventing said bottom sheet from being pulled from the mattress if said top sheet is pulled in a direction generally from said foot end to said head end; and wherein said head end pocket extends along the bottom surface from said head end for a length less than the thickness of the mattress for allowing removal of said bed clothes from the mattress.

18. The bed clothes of claim 17, wherein said head end pocket and said foot end pocket each comprise a bottom panel suitable for extending under the bottom surface of the mattress, said bottom panel including reinforcing material for causing substantially all stretching of said bottom sheet to occur over the upper surface and said side surfaces of the mattress.

* * * * *

UNITED STATES PATENT AND TRADEMARK OFFICE

CERTIFICATE OF CORRECTION

PATENT NO : 6,108,836

DATED : August 29, 2000

INVENTOR(S) : James Henry Keene III

It is certified that error appears in the above-identified patent and that said Letters Patent is hereby corrected as shown below:

In the specification, column 5, line 9, after "occur" insert --over–;
column 5, line 13, replace "ahead" with --a head--; and
column 5, line 33, after "occur" insert --over--.
Column 6, line 55, replace "I" with --l--.
Column 7, line 12, replace "W" with --w--.
In Claim 3, column 8, line 3, replace "cloths" with --clothes–; and
Claim 11, column 8, line 46, replace "cloths" with --clothes--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*